US006595281B1

(12) United States Patent
Beach

(10) Patent No.: US 6,595,281 B1
(45) Date of Patent: Jul. 22, 2003

(54) APPARATUS FOR DELIVERING A FLOWABLE SUBSTANCE TO A REMOTE LOCATION

(75) Inventor: Andrew Beach, Boddington (AU)

(73) Assignee: Industrial Innovations & Concepts PTY LTD, Wa (AU)

( * ) Notice: Subject to any disclaimer, the term of this patent is extended or adjusted under 35 U.S.C. 154(b) by 0 days.

(21) Appl. No.: 09/856,109

(22) PCT Filed: Nov. 16, 1999

(86) PCT No.: PCT/AU99/01008

§ 371 (c)(1),
(2), (4) Date: Jul. 25, 2001

(87) PCT Pub. No.: WO00/29712

PCT Pub. Date: May 25, 2000

(30) Foreign Application Priority Data

Nov. 17, 1998 (AU) ..... PP 7137

(51) Int. Cl.[7] ..... E21B 34/00

(52) U.S. Cl. ..... 166/169; 166/334.4; 175/317; 175/228

(58) Field of Search ..... 166/169, 332.5, 166/334.1, 334.4; 175/227, 228, 320, 317

(56) References Cited

U.S. PATENT DOCUMENTS 1,453,875 A * 5/1923 Huges ..... 175/228
1,619,328 A * 3/1927 Beckenstein ..... 175/239
2,128,352 A * 8/1938 Creighton ..... 166/318
3,175,628 A * 3/1965 Dellinger ..... 175/215
3,220,496 A * 11/1965 Beck ..... 138/42
3,529,683 A * 9/1970 Mays ..... 175/228
4,062,406 A 12/1977 Akkerman et al.
4,860,825 A 8/1989 Corteville et al.

FOREIGN PATENT DOCUMENTS

AU 49480/79 12/1979
JP 09-072183 3/1997

* cited by examiner

*Primary Examiner*—Lynne H. Browne
*Assistant Examiner*—Kenn Thompson
(74) *Attorney, Agent, or Firm*—Edell, Shapiro & Finnan

(57) ABSTRACT

The apparatus (10) for delivering grease through the individual string (12) includes a tubular member (14) for holding a supply of grease, a piston (16) sealing slidable through the tubular member (14) and a first valve (18) coupled to a downstream end (20) of the member (14). Valve (18) has a body (22) provided with orifices (24) and a collar (26) slidably mounted over an end of the body (22) and biased to a sealing position in which it seals the orifices (24). Piston (16) is initially located above an upstream end (28) of the tubular member (14). Apparatus (10) is slid through the drill string (12) until collar (26) abuts a stub, typically a core bit retained at the end of the string. Fluid pressure is then applied to apparatus (10) by pumping water or mud down the drill pipe (12). This forces collar (26) to be displaced in covering the orifices (24). This allows the fluid pressure to push piston (16) through the tubular member (14) to force grease through the orifices (24) and out the downstream end of stream (12).

29 Claims, 6 Drawing Sheets

APPARATUS FOR DELIVERING A FLOWABLE SUBSTANCE TO A REMOTE LOCATION

FIELD OF THE INVENTION

The present invention relates to an apparatus for delivering a flowable substance to a remote location through a conduit, and in particular, but not exclusively, to an apparatus for delivering a lubricant such as grease to the down hole end of, and through, a ground drill.

BACKGROUND OF THE INVENTION

In the types of down hole drilling where drilling muds are not used for transmitting operational power or torque to a drill drive sub it is desirable to provide a lubricant to minimise friction between the outer circumferential surface of the drill string and the surface of the hole. Reducing the friction reduces the torque and power requirements for the motor driving the drill.

In a non limiting example, in core drilling where torque for drilling is provided by a ground level motor, lubrication is typically achieve in one of two ways. Either drilling mud is pumped through the drill string and forced out the bottom of the down hole end of the drill string back up the hole between the surface of the hole and outer circumferential surface of the drill string. Alternatively, when the string is pulled to change the bit, as the drill pipes forming the drill string are connected together and lowered back into the ground at least the lower most pipes are manually covered in grease to provide the lubrication.

Drilling mud is more expensive per unit volume than grease and therefore from the point of view of cost it is preferred to use grease. However the grease is only applied when the drill string is pulled to change the drill bit and typically this is done as sparingly as possible because tripping the drill can take substantial amounts of time and therefore in itself costs considerable sums of money. In addition, by virtue of the RETRACTABIT (™) system for in situ replacement of drill bits, the need to trip the drill string to change a drill bit has largely been eliminated. In this instance, if one where to use grease as the lubricant, one would need to trip the drill string simply for the purpose of applying lubricant. Depending on the length of the drill string this may take upwards of 12 hours.

SUMMARY OF THE INVENTION

The present invention was developed to provide an apparatus that is capable of delivering a lubricant such as grease to lubricate the outer peripheral/circumferential surface of the drill string while it remains in the ground. However, as will be apparent from the following description, embodiments of the apparatus can deliver any flowable substance to a remote location through any conduit.

According to the present invention there is provided an apparatus for delivering a flowable substance to a remote location through a conduit having an upstream end for insertion of the apparatus, a downstream end provided with an opening, and a stopping means for stopping the apparatus from falling out the downstream end of the conduit, said apparatus comprising at least:

a tubular member for holding a supply of flowable material;

a piston sealingly slidable through the tubular member, the piston initially located upstream of the tubular member; and, a first valve coupled to a downstream end of the tubular member the first valve having a body provided with at least one orifice and a sealing member slidably mounted on the body and biased to a sealing position in which it seals said at least one orifice;

whereby, in use, said apparatus is inserted in the upstream end of and transported through the conduit where, upon the sealing member abutting the stopping means, fluid pressure is applied to the apparatus through the conduit displacing the sealing member away from the sealing position to unseal any one or more of the at least one orifice and pushing the piston through the tubular member to force the flowable substance through said any one or more of the orifices and out the downstream end of the conduit.

Preferably the seal formed by the piston in the tubular member is arranged to fail when the fluid pressure exerted exceeds a predetermined level so that the fluid exerting the pressure can bypass or otherwise flow through the piston and subsequently flow through any one or more of orifices unsealed by the sealing member and out the downstream end of the conduit.

Preferably the apparatus includes a resilient sealing ring for biasing the sealing member toward the sealing position, the resilient sealing ring disposed about the body of the first valve and adapted to form a first seal between the an outer peripheral surface of the apparatus and an inner surface of the conduit near the downstream end of the conduit when the sealing member is displaced away from the sealing position.

Preferably the body includes a constant diameter portion on which the sealing member is mounted and a contiguous tapered portion having increasing outer diameter in an upstream direction so that when the sealing member is displaced away from the sealing position, the sealing member forces the resilient sealing ring up the tapered portion, radially outwardly expanding the resilient sealing ring into substantial sealing contact between the inner peripheral surface of the conduit and the outer peripheral surface of the apparatus.

Preferably the apparatus further includes fluid flow control means coupled upstream of the tubular member, said fluid flow control means including peripheral sealing means for forming a second seal between the outer peripheral surface of the apparatus and an inner peripheral surface of the conduit upstream of the tubular member thereby directing the fluid exerting the pressure to flow through an opening at the upstream end of the apparatus.

Preferably the fluid flow control means includes a bypass valve at the upstream end of the apparatus movable between a closed position in which the fluid is substantially confined to act directly on the piston, and an open position providing fluid communication between the upstream end of the apparatus, a space formed between the outer peripheral surface of the apparatus and the inner peripheral surface of the conduit downstream of the peripheral sealing means and the opening at the downstream end of the conduit, said bypass valve being operable to switch to the open position when the apparatus is being withdrawn from the conduit.

Preferably the fluid flow control means further includes an outer pipe which is provided with the peripheral sealing means, and the bypass valve includes a hole in the outer pipe and an inner pipe slidable within the outer pipe between a closed location where the inner pipe substantially seals the hole and at an open location where the inner pipe unseals the hole.

Preferably the inner pipe is adapted for connection to means for retrieving the apparatus from the conduit so that when the apparatus is being retrieved, the inner pipe is pulled by the retrieving means to the open location at which position the inner pipe engages the outer pipe to facilitate withdrawal of the whole apparatus from the conduit, and wherein fluid above the apparatus can flow through the bypass valve and out the downstream end of the conduit.

Preferably, the tubular member and piston are constituted as a disposable unit demountably connectable at a downstream end to the valve and at an upstream end to the fluid flow control means.

Preferably said piston includes a passageway extending axially there through and means demountably held in the passageway for initially closing said passageway, said means adapted to be ejected from said passageway to open said passageway when the fluid pressure exceeds said predetermined level to facilitate said failure of said piston.

Preferably said piston is provided with an inner cylindrical body defining the passageway, and wherein the means for initially closing the passageway is a ball.

Preferably the passageway is provided with a recess for snap fitting of said means for initially closing the passageway.

Preferably said apparatus further includes a bypass insert held with said first valve downstream of said piston for spacing said ball from said at least one orifice and maintaining a fluid flow path around said ball to said at least one orifice.

BRIEF DESCRIPTION OF THE DRAWINGS

An embodiment of the present invention will now be described by way of example only with reference to the accompanying drawings in which.

DETAILED DESCRIPTION OF PREFERRED EMBODIMENT

Figure 1:
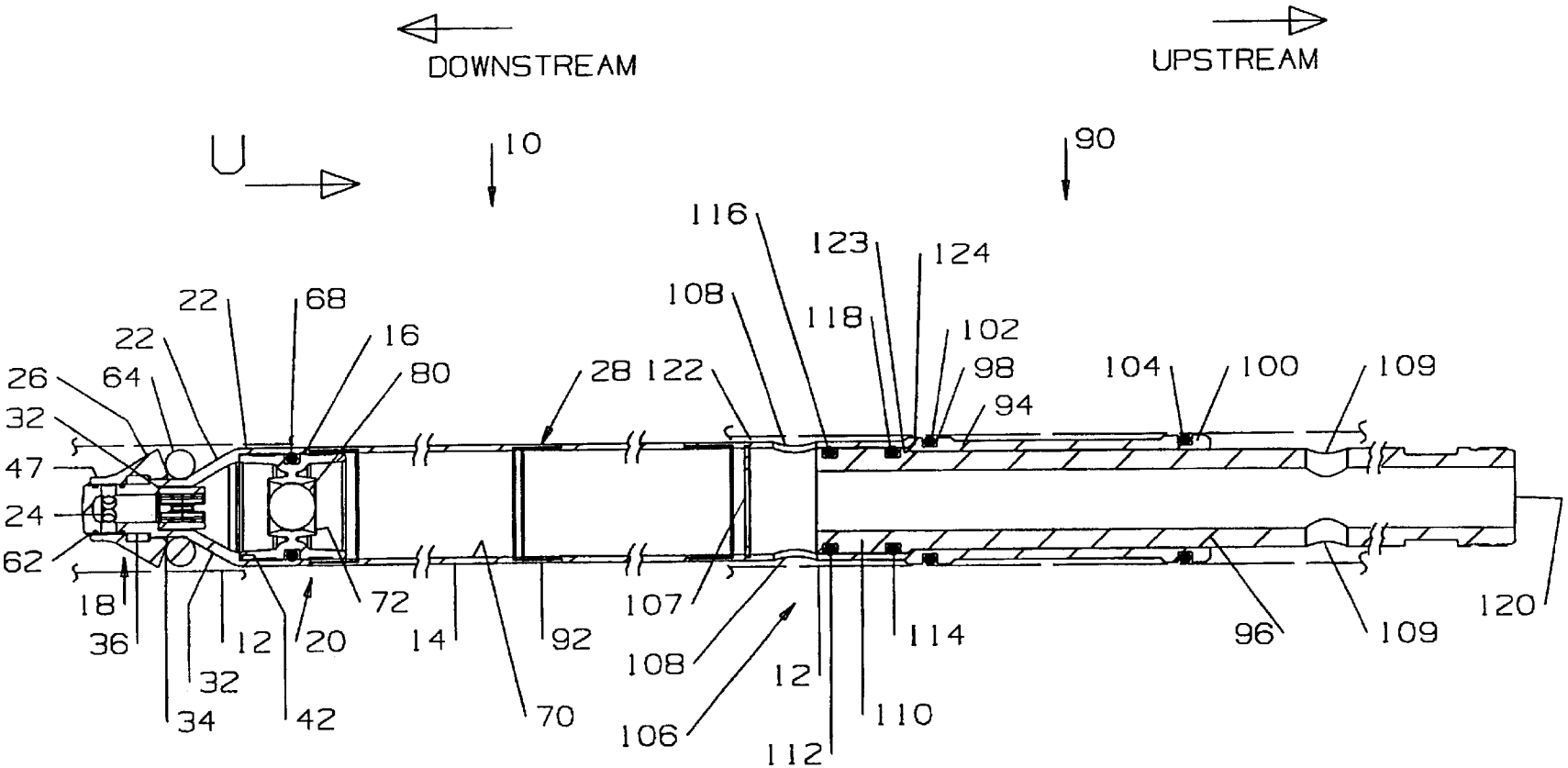
FIG. 1 is a longitudinal section view of an embodiment of the apparatus for delivering a flowable substance to a remote location through a conduit.

FIG. 1 illustrates an embodiment of the apparatus 10 for delivering a flowable substance such as grease through a conduit in the form of a drill string 12 (only a portion of which is shown in phantom). The drill string 12 has an upstream end (not shown) which would be at ground level for insertion of the apparatus 10 and a downstream end, in a hole being drilled having an opening through which the flowable substance can pass, and a stopping means for stopping the apparatus 10 from falling out the downstream end of the drill pipe 12. As explained in greater detail below, the stopping means would typically be the inside of a core drill bit attached to the end of the drill string.

The apparatus 10 includes a tubular member 14 for holding a supply of grease, a piston 16 sealing slidable through the tubular member 14 and a first valve 18 coupled to a downstream end 20 of the tubular member 14. The first valve 18 has a body 22 provided with orifices 24 and a sealing member in the form of a collar 26 slidable mounted on the body 22 and biased to a sealing position (shown in FIG. 1) in which the collar 26 seals the orifices 24.

When the apparatus 10 is used, the piston 16 is initially located above upstream end 28 of the tubular member 14. The apparatus 10 is inserted in the upstream end other than transported through the drill string 12 until the collar 26 abutting the stopping means. Then fluid pressure is applied to the apparatus 10 typically by pumping water down drill pipe 12. This initially forces the collar 26 to be displaced (ie slide backwardly) relative to the body 22 away from the sealing position to unseal the orifices 24. Subsequently, the fluid pressure pushes the piston 16 through the tubular member 14 to force the grease through the orifices 24 and out the downstream end of the drill string 12. It is to be noted that the fluid pressure cannot force the piston 16 to travel through the tubular member 14 from the upstream end 28 to the downstream end 22 until the collar 26 is moved away from its sealing position. This is because until the holes 24 are uncovered or unsealed the grease, being substantially incompressible, prevents the piston 16 from moving.

When apparatus 10 is used to deliver grease through a core drill, the tubular member 14 would typically be in the form of a shortened length of standard core tube and provided with screw threads at downstream and upstream ends 20,28 for coupling to other components of the apparatus 10.

Figure 2B:
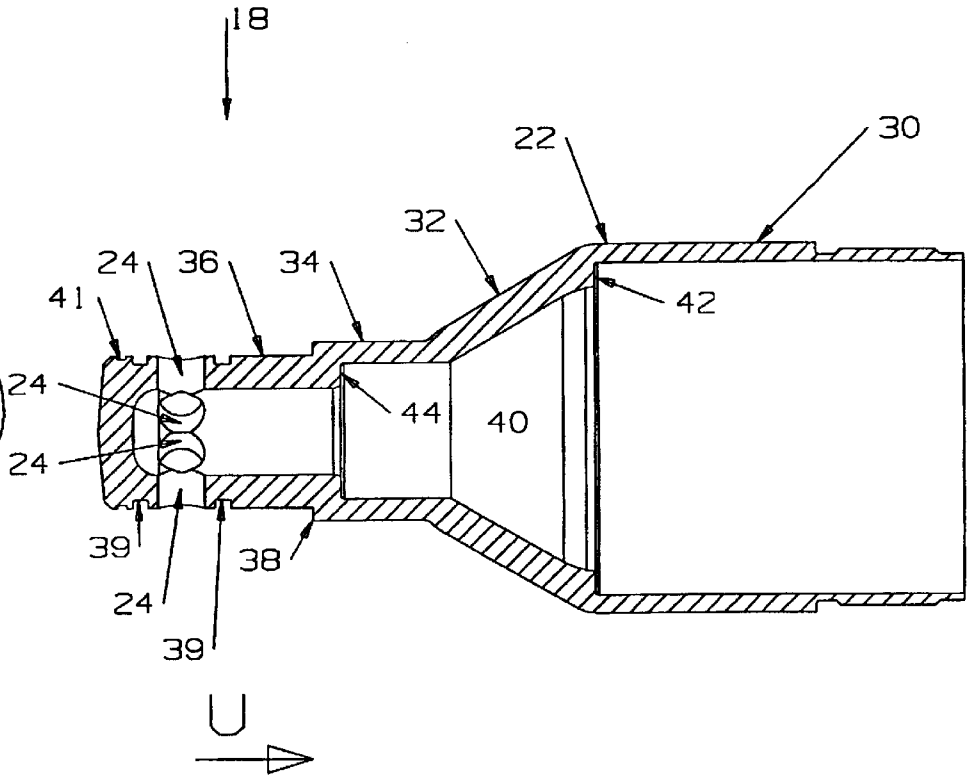
FIG. 2B is a longitudinal section view of a body of the valve shown in FIG. 2A.
Figure 2A:
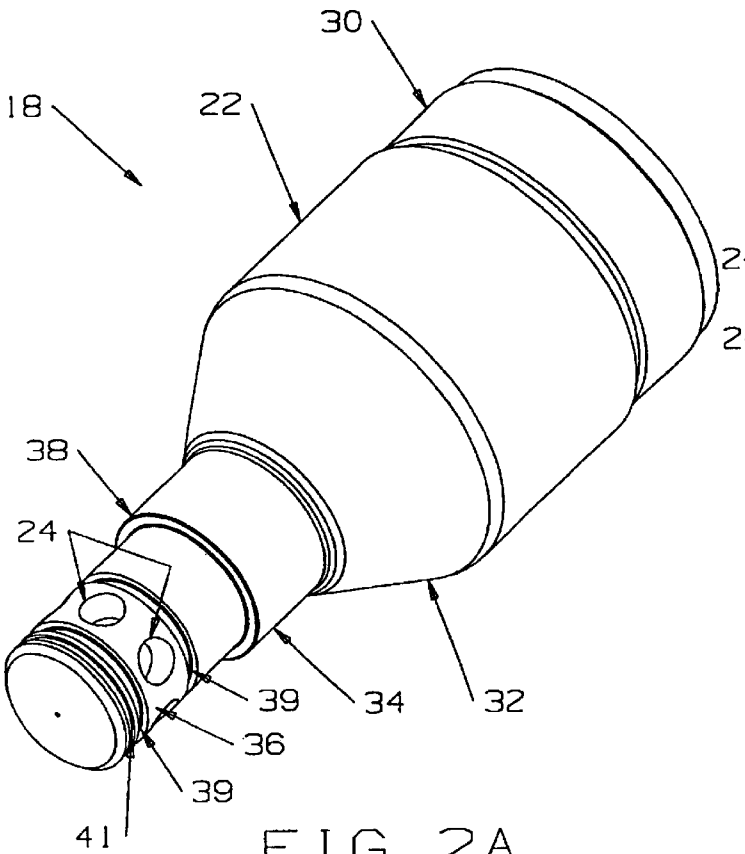
FIG. 2A is an isometric view of a portion of the valve incorporated in the apparatus shown in FIG. 1.

Referring to FIGS. 2A and 2B, the body 22 of the valve 18 has an upper cylindrical portion 30 for housing the piston 16 once the piston 16 has been forced by fluid pressure through the tubular member 14. Contiguous with the cylindrical portion 30 in the downstream direction is a tapered or frusto conical portion 32. The frusto conical portion 32 tapers so as to increase in outside diameter in the upstream direction shown by arrow U. Contiguous and concentric with the frusto conical portion 32 is a constant diameter portion 34 along which the collar 26 is partly seated. Contiguous with the constant diameter portion 34 in the downstream direction is a nose portion 36 of constant but stepped down outer diameter. Indeed, a step 38 is formed at the location where the nose 36 adjoins the constant diameter portion 34. Two circumferential grooves 39 are formed on the nose 36 on opposite sides of the holes 24 for receiving O-ring seals (not shown). A further circumferential groove 41 is formed in the nose 36 downstream of the most downstream groove 39.

The inside of the body 22 defines a passageway 40 through which grease can flow when pressure is applied to the piston 16 and the collar 26 has been moved away from its sealing position to uncover the holes 24. The passageway 40 is also formed with an annular internal stop face 42 coincident with the transition from the cylindrical portion 30 to the frusto conical portion 32; and a further annular stop face 44 coincident with the transition from the constant diameter portion 34 to the nose 36.

Figure 3B:
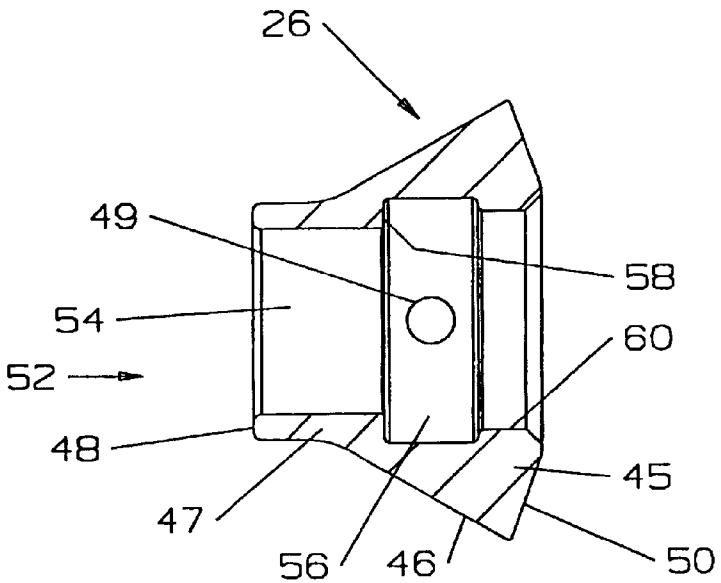
FIG. 3B is a sectional view of the collar shown in FIG. 3A.
Figure 3A:
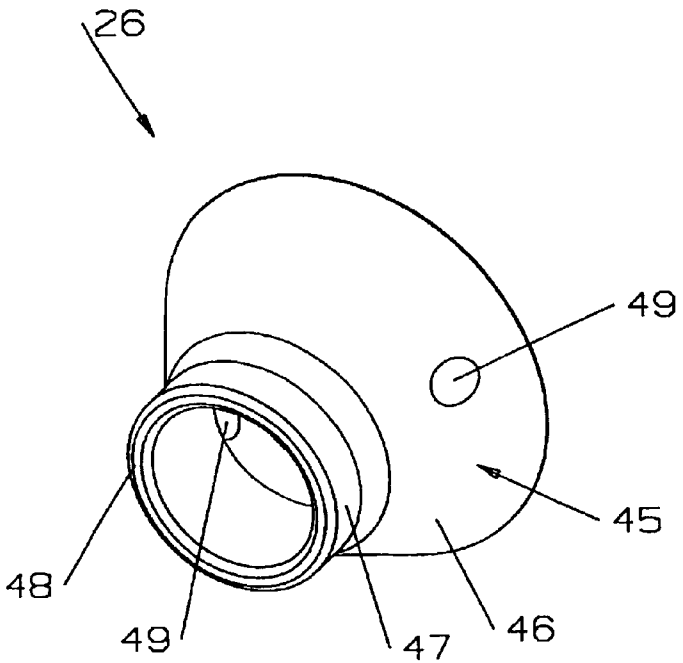
FIG. 3A is a isometric view of a collar forming part of the valve incorporated in the apparatus shown in FIG. 1.

Referring to FIGS. 3A and 3B the collar 26 has a frusto conical portion 45 with corresponding outer surface 46 that leads to a cylindrical spigot 47 provided with a substantially flat front face 48. The back end of the frusto conical portion 45 has a tapered rear face 50. A bore 52 is formed centrally through the collar 26 to allow for mounting on the body 22. The bore 52 is provided with portions of different diameter so as to form internal steps in the collar 26. A forward most portion 54 of the bore 52 as the diameter marginally larger than the outer diameter of the nose 36. Upstream of portion 54 is a second portion 56 of greater internal diameter thereby forming a annular stop face 58 in the bore 52 at the transition between the portions 54 and 56. Bleed/pressure relief holes 49 are formed through the frusto conical portion 45 into the portion 56. Upstream of the portion 56 is a further portion 60 of the bore 52 having an internal diameter marginally greater than the outer diameter of the constant diameter portion 34 of the body 22.

As shown in FIG. 1 when the collar 26 is in the sealing position, portion 54 covers the orifices 24 in the nose 36. O-rings in the grooves 39 of the nose 36 form a seal on opposite sides of the holes 24 with inside portion 54 of the spigot 47. The collar 26 is retained on the nose 36 by way of a circlip 62 seated in the circumferential groove 41. It will also be recognised that the bleed holes 49 are opposite the portion of the nose 36 behind (upstream) the grooves 39. The holes 49 simply act to relieve any air/fluid pressure that may otherwise build up between the collar 26 and nose 36 when the collar 26 is moved away from its sealing position.

A resilient sealing ring 64 (refer FIG. 1) is disposed about the body 22. When the collar 26 is in the sealing position (shown in FIG. 1) the ring 64 is disposed about the body 22 in the region where the constant diameter portion 34 and the tapered portion 32 meet. The ring 64 and collar 26 are relatively dimensioned so that when in this position, the ring 64 abuts the rear surface 50 of the collar 26. The ring 64 is dimensioned so that it is marginally expanded when on the constant diameter portion 34.

Figure 4:
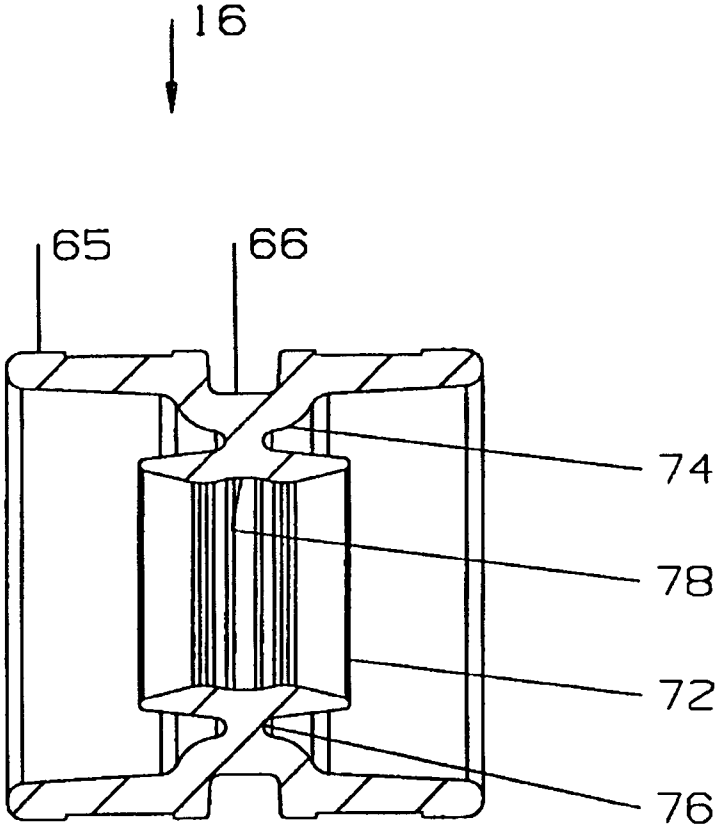
FIG. 4 is a cross sectional view of a part of a piston incorporated in the apparatus shown in FIG. 1.
Figure 5C:
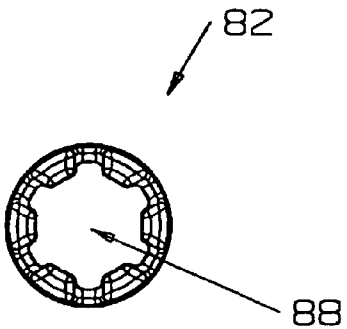
FIG. 5C is a top view of the insert shown in FIGS. 5A and 5B.
Figure 5B:
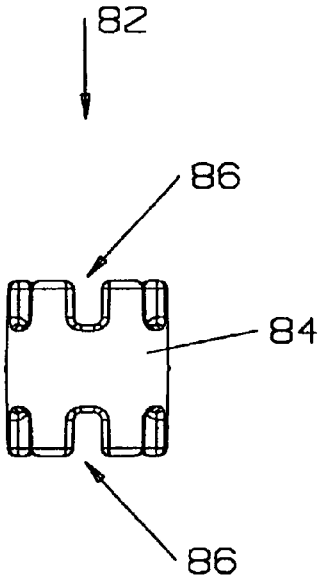
FIG. 5B is a side view of the insert shown in FIG. 5A.
Figure 5A:
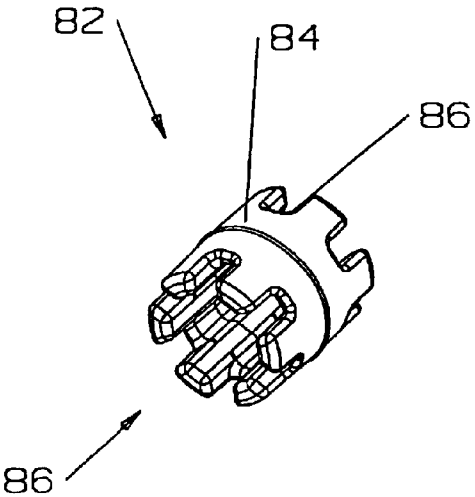
FIG. 5A is an isometric view of a bypass insert incorporated in the apparatus shown in FIG. 1.

Referring to FIG. 4 the piston 16 includes an outer cylindrical body 65 provided with a circumferential groove 66 about its outer surface and midway along its length. The groove 66 seats an O-ring 68 (shown in FIG. 1) that forms a seal against the inner circumferential surface 70 of the tubular member 14. The piston 16 also an axially extending passageway defined by an integrally formed inner cylindrical body 72 cocentric with the outer cylindrical body 65. The inside surface of the outer cylindrical body 65 is provided with a generally convex hump 74 opposite the groove 66. An annular neck 76 attaches the inner cylindrical body 72 to the hump 74. It is envisaged that the inner and outer cylindrical elements 65,72 the hump 74 and the neck 76 be integrally formed from a plastics material such as thermoplastic polyamide 11,12. The inside surface of the inner cylindrical element 72 is provided with a generally concave recess 78 midway along its length for snap receiving means for selectively opening and closing the body 72 in the format a ball bearing 80 (see FIG. 1). The piston 16 is designed so that when the pressure exerted thereon is below a predetermined level, the ball bearing 80 remains fixed within the inner cylindrical element 72 and thus fluid pressure acting on the piston 16 causes the piston to travel or sealing slide through the tubular element 14. However, when the fluid pressure exceeds a predetermined level, and the piston 16 is arrested from sliding motion, the pressure forces the ball bearing 80 out of inner cylindrical element 72 to allow fluid to flow through the piston 16.

A bypass insert 82 (FIGS. 1, and 5A–5C) is held within the constant diameter portion 34 of the body 22 resting against the annular surface 44. The insert 82 is in the form of a short tube 84 having castellations 86 at its opposite end and a central passageway 88. When the ball bearing 80 is forced out of the piston 16, it rests on the castellations 86 at one end of the insert 82 so that the fluid exerting the pressure can pass around the ball 80 through the castellations 86, passage 88 and then out through the orifices 24.

Referring back to FIG. 1, the apparatus 10 includes a fluid flow control means 90 coupled upstream of the tubular member 14. Typically, the means 90 will be coupled via a conventional core tube 92 to the upstream end of the tubular member 14. The means 90 includes an outer pipe 94 screw coupled to the core tube 92, and an inner pipe 96 slidably retained inside the outer pipe 94. The outside surface of the outer pipe 94 is provided with two spaced apart circumferential grooves 98 and 100 for seating O-rings 102 and 104 respectively. The O-rings 102 and 104 can be considered as peripheral sealing means forming a seal about the outer peripheral surface of the apparatus 10 and the inner surface of the drill pipe 12 upstream of the tubular member 14. The means 90 also includes a bypass valve shown generally as item 106 in FIG. 1. The bypass valve 106 includes holes 108 formed in the outer pipe 94 and lower end 110 of the inner pipe 96. The lower end 110 is provided with two spaced apart circumferential grooves 112,114 for seating O-rings 116 and 118 respectively. When the inner pipe 96 is slid to its lower most position the O-rings 116 and 118 are spaced on the opposite sides of the holes 108 thereby sealing the holes and closely the valve 106. The lower most position of inner pipe 96 is limited by a circlip or flange 107 provided inside outer pipe 94 downstream of the holes 108. Fluid flow holes 109 are formed in the inner pipe 96 and located so as to always lie outside (ie upstream) of outer pipe 94. The inner pipe 96 may be of an extended length to provide it with substantial weight to ensure that it slides downwardly to close the valve 106 when the inner pipe 96 is not supported. When the valve 106 is closed, any fluid pumped down the drill string 12 is directed to flow through opening 120 at the upstream end of the pipe 96 and acts essentially directly on the piston 16. When the bypass valve 106 is in the open position, as shown in FIG. 1, fluid communication is provided along a path comprising the upstream end of the apparatus 10 (via opening 120), annular space 122 formed between the outer peripheral surface of the apparatus 10 in the inner peripheral surface of the drill string 12 downstream of the seal formed by the O-rings 102,104 and, the opening at the downstream end of the drill string 12.

The outside surface of the inner pipe 96 and the inside surface of the outer pipe 94 are provided with complimentary circumferential tapered surfaces 123 and 124. These surfaces come into mutual abutment to limit sliding of the inner pipe 96 outwardly from the outer pipe 94.

Figure 6:
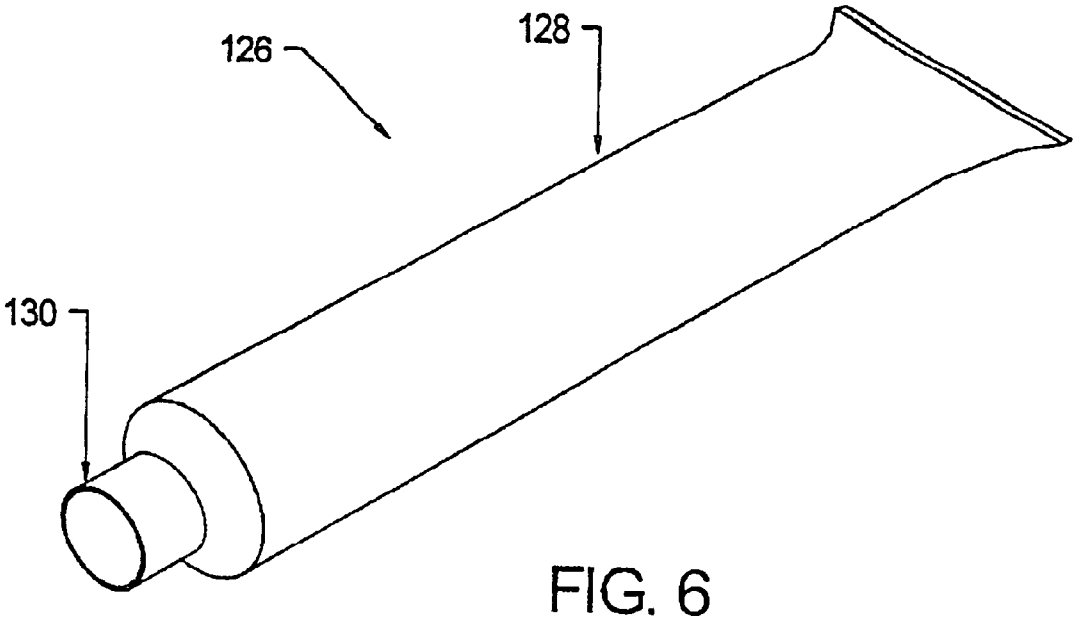
FIG. 6 is an artistic representation of a tube of flowable substance adapted for use with the apparatus; and, FIG. 7 is a side view of an adaptor for coupling the tube of FIG. 6 to the apparatus.
Figure 7:
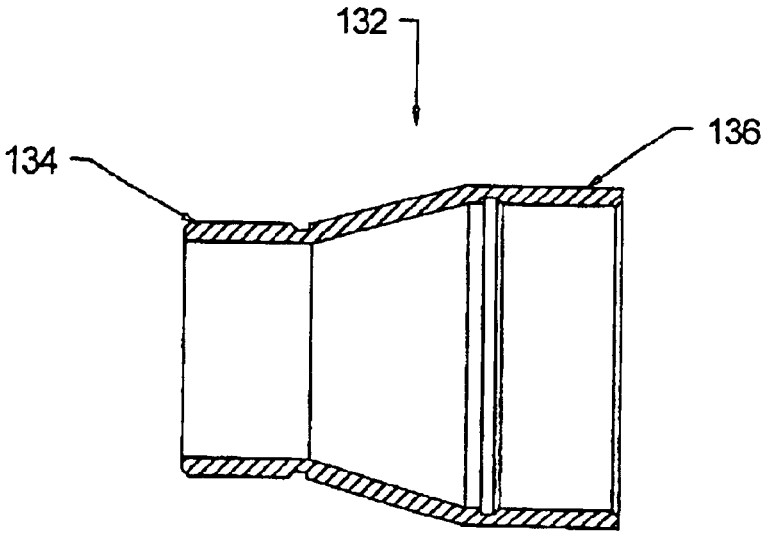

A flexible grease tube 126 has depicted in FIG. 6 can be used to load grease (or any other flowable substance) into the tubular member 14. The tube 126 has a body 128 made of thin walled plastics material with an integrally formed neck 130 at one end. The opposite end of the body 128 is closed. In general terms, the grease tube 126 has a form similar to a tube of toothpaste although is substantially larger. The neck 130 is provided with a screw thread either on its inner or outer surface for threadingly coupling to an adaptor 132 shown in FIG. 7. The adaptor 132 is in the form of a short length of tube having two contiguous sections 134, 136 of different diameter. First section 134 is provided with a screw thread for threadingly engaging with the thread on neck 130. Second section 136 is dimensioned and formed to threadingly engage with the tubular member 14. Thus, adaptor 132 facilitates coupling of the tube 126 to the member 14. As previously mentioned, the tubular member 14 would normally take the form of a conventional core tube. It is known that core tubes come in several different sizes for example HQ, NQ and BQ. It is envisaged that a range of adaptors 132 will be available which differ in the diameter of their respective second sections 136 to accommodate members 14 of different size. The respective first sections 134 would ordinarily be identical.

The tube 126 can be provided with means to assist in the squeezing of the grease contained therein out of the neck 130 into the tubular member 14. This could be in the form of a elongated member of a length greater than the transverse length of the tube 126 and provided with a slot into which the end of the body 128 opposite the neck 130 can be inserted. The elongated member can then be turned about its length to roll up the body 128 from its end thus forcing grease out of the neck 130.

The operation of the apparatus 10 will now be described.

In order to deliver a flowable substance such as grease down a drill string 12 having one end located down a hole being drilled, the tubular member 14 is filled with grease and the valve 18 screwed to a downstream end thereof. The piston 16 is disposed upstream of the tubular member 14 and typically at or near the upstream end 28. The fluid flow control means 90 is then screwed onto the core tube 92 and a standard spear point (not shown) screw coupled to the end of inner pipe 96 about the opening 120. While attached to the spear point, the inner pipe 96 is pulled back relative to the outer pipe 94 because of the weight of the downstream components of the apparatus 10, with surfaces 123 and 124 in abutting contact and the valve 106 open. The apparatus 10 is then lowered through the drill string 12 typically by a wire line attached to the spear point by a conventional overshot (not shown) (although in an alternative embodiment the apparatus 10 can pump down the drill string 12 by a fluid). During this process the O-rings 102 and 104 form a seal upstream of the tubular element 14. At some point the wire line is decoupled from the spear point by conventional means. This usually will occur when either the apparatus 10 reaches water in the drill string 12 or the collar 26 hits the inside of a core bit at the lower most end of the drill string 12. When the wire line is released the combination of the weight of the inner pipe 96 and gravity causes the inner pipe to slide in the downstream direction until it abuts the circlip/flange 107 so that O-rings 116,118 locate on opposite sides of holes 108 and close the bypass valve 106. At this point, a fluid, typically water is pumped down the drill string 12 with gradually increasing pressure. Because of the seal formed by the O-rings 102 and 104, substantially of the water enters the inner pipe 96 and the apparatus 10 through the openings 120 and 109. As valve 106 is closed, fluid pressure is applied directly on the piston 16. The fluid pressure therefore acts to push the apparatus 10 home with the collar 26 abutting the inside of the core bit (not shown) at the downstream end of the drill string 12. With every increasing fluid pressure, the tubular member 14 and body 22 are forced in the downstream direction relative to the collar 26 which is held stationary because of its abutment with the inside of the core drill bit. It is to be noted that the piston 16 cannot travel any substantive distance down the tubular element 14 until the collar 26 is moved relative to the body 22 away from its sealing position because of the substantive compressibility of the grease filled within the tubular element 14.

As the tubular element 14 and body 22 move forward relative to the collar 26, the holes 24 are effectively opened and the resilient sealing ring 64 is forced up the tapered portion 32 of the body 22 so as to expand radially outwardly. This creates a seal about the apparatus 10 and the inside surface of the drill string 12/core bit at location close to and upstream of the holes 24. Now the fluid pressure exerted on the piston 16 enables the piston 16 to slide through the tubular element 14. This results in the grease within the tubular element 14 being pushed through the body 22, insert 82, out holes 24 and out of the lower end of the drill string 12. The grease is substantially prevented from flowing back up the inside of the drill string 12 by virtue of the seal formed by the resilient sealing ring 64. Thus, the grease is forced to flow back up the hole being drilled on the outside of the drill string 12 thereby lubricating the outside of the drill string 12. Eventually, the sliding motion of the piston 16 is halted by the piston 16 abuting the stop face 42. However, the pressure of the fluid within the drill string 12 continues to increase. This pressure reaches a predetermined level at which it forces the ball 80 out of the inner cylindrical element 72 of the piston 16. The seal created by the piston 16 now fails and the water exerting the pressure on the piston 16 is able to flow through the cylindrical element 72 through the insert 82, holes 24 and back up the hole on the outside of the drill string 12. This assists in clearing out any grease remaining within the apparatus 10 and in particular body 22, and forces the grease some distance up the hole coating the outside surface of the drill string. The ball 80 is prevented from blocking the flow of the fluid by the insert 82 because the fluid can flow through the castellations 86 when the ball 80 is in direct contact with the insert 82. On the failure or bypassing of the piston 16, there will be a sharp drop in the water pressure. This sharp drop will be detected by conventional pressure sensors and monitored at the surface of the drilling equipment to provide a rig operator with confirmation that the grease within the tubular element 14 has been delivered through the drill string 12 to coat the outside of at least a lower portion of the drill string 12.

The apparatus 10 can now be retrieved by dropping an overshot on the wire line down the drill string 12 to couple with the spear point (not shown) attached to pipe 96. As the wire line is reeled in, the inner pipe 96 slides upwardly inside the outer pipe 94 until the surfaces 123 and 124 come into abuting contact. When this occurs, the valve 106 is effectively opened. Now, as the wire line is continued to be reeled in, the whole of the apparatus 10 is pulled upwardly through the drill string 12. The opening of the valve 106 means that as the apparatus 10 is pulled upwardly it is pulled through the column of water that would be above it in the drill string 12 because the water can flow through the inner pipe 96, holes 108 and between the outer peripheral surface of the apparatus 10 and the inner surface of the string 12. Accordingly when retrieving or pulling the apparatus 10 upwardly through the drill string 12 one is not also required lift a column of water of volume substantially the same as the interior volume of the drill string 12. Also, this effectively bypasses the seal created by O-rings 102 and 104 between the apparatus 10 and drill string 12. This is significant because it prevents the withdrawal of the apparatus 10 creating a suction force that would suck the grease back up the drill string 12. It should also be mentioned here that upon initially retrieving the apparatus 10, the inherent resilience of the resilient sealing ring 64 causes it to slide or roll back down the tapper surface 32, out of sealing contact with the inner surface of the drill string 12/core bit.

When the apparatus 10 has been fully withdrawn from the drill string 12, the corresponding drill then can return to its normal drilling operation. Whenever it is desired to regrease the string 12, the above process is simply repeated.

Now that an embodiment of the apparatus 10 has been described, it will be apparent to those skilled in the relevant arts that numerous modifications and variations may be made without departing from the basic inventive concepts. For example, the piston 16 can be made in any form or configuration which initially operates under fluid pressure to force the grease or flowable substance out of the tubular element 14 and, after a predetermined pressure is reached, fails busts or otherwise breaks to allow the fluid exceeding the pressure to flow through or bypass the piston 16. In another variation it is envisaged that the tubular element and piston 16 can be in the form of a disposable cartridge that can be connected into and out of the apparatus 10. In this embodiment, a removable end cap (not shown) can be provided at the downstream end of the cartridge and the piston 16 provided at the upstream end in a configuration somewhat similar to a conventional grease, adhesive, or corking compound cartridge. The significant difference however between the present envisaged cartridge and the aforementioned prior art cartridges is that the piston 16 is designed to fail, burst or otherwise break when subjected to a predetermined fluid pressure. This can be achieved by forming the piston with creases or lines of weakness that cause the piston to rupture or burst when subjected to the determined fluid pressure. Further, as is obvious, any flowable substance can be placed within the tubular element 14 such as for example, glue, or grout. Also, the apparatus 10 can be used for delivering the flowable substance through any conduit not just a drill string. All such modifications and variations together with those that will be obvious to a person of ordinary skill in the art are deemed to be within the scope of the present invention the nature of which is to be determined from the above description and the appended claims.

The claims defining the invention are as follows:

1. An apparatus for delivering a flowable substance to a remote location through a conduit having an upstream end for insertion of the apparatus, a downstream end provided with an opening, and a stopping means for stopping the apparatus from falling out the downstream end of the conduit, said apparatus comprising at least:

a tubular member for holding a supply of said flowable substance;

a piston sealingly slidable through the tubular member, the piston initially located upstream of the tubular member; and, a first valve coupled to a downstream end of the tubular member the first valve having a body provided with at least one orifice and a sealing member slidably mounted on the body and biased to a sealing position in which it seals said at least one orifice;

wherein said apparatus is insertable into the upstream end of and transported through the conduit such that the sealing member abuts the stopping means and, upon application of fluid pressure to the apparatus through the conduit, the sealing member is displaced away from the sealing position to unseal any one or more of the at least one orifice and the piston is pushed through the tubular member to force the flowable substance through any one or more of the at least one orifice and out the downstream end of the conduit.

2. An apparatus for delivering a flowable substance to a remote location through a conduit having an upstream end for insertion of the apparatus, a downstream end provided with an opening, and a stopping means for stopping the apparatus from falling out the downstream end of the conduit, said apparatus comprising at least:

a tubular member for holding a supply of said flowable substance;

a piston slidable through the tubular member and forming a first seal with said tubular member; the piston initially located upstream of the tubular member; and, a first valve coupled to a downstream end of the tubular member the first valve having a body provided with at least one orifice and a sealing member slidably mounted on the body and biased to a sealing position in which it seals said at least one orifice;

said apparatus being insertable in the upstream end of and transported through the conduit where, upon he sealing member abutting the stopping means, fluid pressure is applied to the apparatus through the conduit displacing the sealing member away from the sealing position to unseal one or more of the at least one orifice and pushing said piston through said tubular member to force said flowable substance through any one or more of the at least one orifice and to the downstream end of the conduit;

said seal formed by said piston and said tubular member being arranged to fail when the fluid pressure exerted exceeds a predetermined level so that said fluid exerting the pressure can bypass or otherwise flow through said piston and subsequently flow through said at least one orifice unsealed by the sealing member and to the downstream end of the conduit.

3. The apparatus according to claim 2 wherein said piston includes a passageway extending axially there through and a plug demountably held in the passageway for initially closing said passageway, said plug being ejected from said passageway to open said passageway when the fluid pressure exceeds said predetermined level to facilitate said failure of said seal.

4. The apparatus according to claim 3 wherein said passageway is provided with a recess for snap fitting of said plug for initially closing the passageway.

5. The apparatus according to claim 4 wherein said piston is provided with an inner cylindrical body defining the passageway, and wherein said plug for initially closing the passageway is a ball.

6. The apparatus according to claim 5 further including a bypass insert held with said first valve downstream of said piston for spacing said ball from said at last one orifice and maintaining a fluid flow path around said ball to said at least one orifice.

7. The apparatus according to claim 2 further comprising a resilient sealing ring for biasing the sealing member toward the sealing position, the resilient sealing ring disposed about the body of the first vale and adapted to form a first seal between an outer peripheral surface of the apparatus and an inner surface of the conduit near the downstream end of the conduit when the sealing member is displaced away from the sealing position.

8. The apparatus according to claim 7 wherein the body includes a constant diameter portion on which the sealing member is mounted and a contiguous tapered portion having increasing outer diameter in an upstream direction so that when the sealing member is displaced away from the sealing position, the sealing member forces the resilient sealing ring up the tapered portion, radially outwardly expanding the resilient sealing ring into substantial sealing contact between the inner peripheral surface of the conduit and the outer peripheral surface of the apparatus.

9. The apparatus according to claim 8 further including a fluid flow controller coupled upstream of the tubular member, said fluid flow controller including a peripheral seal for forming a second seal between the outer peripheral surface of the apparatus and an inner peripheral surface of the conduit upstream of the tubular member thereby directing the fluid exerting the pressure to flow through an opening at the upstream end of the apparatus.

10. The apparatus according to claim 9 wherein the fluid flow controller includes a bypass valve at the upstream end of the apparatus movable between a closed position in which the fluid is substantially confined to act directly on the piston, and an open position providing fluid communication between the upstream end of the apparatus, a space formed between the outer peripheral surface of the apparatus and the inner peripheral surface of the conduit downstream of the peripheral seal and the opening at the downstream end of the conduit, said bypass valve being operable to switch to the open position when the apparatus is being withdrawn from the conduit.

11. The apparatus according to claim 10 wherein the fluid flow controller further includes an outer pipe which is provided with the peripheral seal, and the bypass valve includes a hole in the outer pipe and an inner pipe slidable within the outer pipe between a closed location where the inner pipe substantially seals the hole and at an open location where the inner pipe unseals the hole.

12. An apparatus according to claim 11 wherein the inner pipe is adapted for connection to means for retrieving the apparatus from the conduit so that when the apparatus is being retrieved, the inner pipe is pulled by the retrieving means to the open location at which position the inner pipe engages the outer pipe to facilitate withdrawal of the whole apparatus from the conduit, and wherein fluid above the apparatus can flow through the bypass valve and out the downstream end of the conduit.

13. An apparatus for delivering a flowable substance to a remote location through a conduit having an upstream end for insertion of the apparatus, a downstream end provided with an opening, and a stopping means for stopping the apparatus from falling out the downstream end of the conduit, said apparatus comprising at least:

a tubular member for holding a supply of said flowable substance;

a piston sealingly slidable through the tubular member, the piston initially located upstream of the tubular member; and, a first valve coupled to a downstream end of the tubular member the first valve having a body provided with at least one orifice, a sealing member slidably mounted on the body and a resilient ring biasing said sealing member into a sealing position in which said sealing member seals said at least one orifice, resilient sealing ring disposed about the body of the first valve and forming a first seal between an outer peripheral surface of said apparatus and an inner surface of the conduit near the downstream end of the conduit when the sealing member is displaced away from the sealing position;

said apparatus being insertable in the upstream end of and transported through the conduit where, upon said sealing member abutting said stopping means, fluid pressure is applied to said apparatus through said conduit displacing said sealing member away from sealing position to unseal any one or more of the at least one orifice and pushing said piston through said tubular member to force the flowable substance through any one or more of the at least one orifice and out the downstream end of the conduit.

14. The apparatus according to claim 13 wherein said body includes a constant diameter portion on which said sealing member is mounted and a contiguous tapered portion having increasing outer diameter in an upstream direction so that when said sealing member is displaced away from said sealing position, said sealing member forces said resilient sealing ring up said tapered portion, radially outwardly expanding said resilient sealing ring into substantial sealing contact between said inner peripheral surface of said conduit and said outer peripheral surface of the apparatus.

15. The apparatus according to claim 14 further including fluid flow controller coupled upstream of the tubular member, said fluid flow controller including a peripheral seal for forming a second seal between the outer peripheral surface of the apparatus and an inner peripheral surface of the conduit upstream of the tubular member thereby directing the fluid exerting the pressure to flow through an opening at the upstream end of the apparatus.

16. The apparatus according to claim 15 wherein the fluid flow controller includes a bypass valve at the upstream end of the apparatus movable between a closed position in which the fluid is substantially confined to act directly on the piston, and an open position providing fluid communication between the upstream end of the apparatus, a space formed between the outer peripheral surface of the apparatus and the inner peripheral surface of the conduit downstream of the peripheral seal and the opening at the downstream end of the conduit, said bypass valve being operable to switch to the open position when the apparatus is being withdrawn from the conduit.

17. The apparatus according to claim 16 wherein the fluid flow controller further includes an outer pipe which is provided with the peripheral seal, and the bypass valve includes a hole in the outer pipe and an inner pipe slidable within the outer pipe between a closed location where the inner pipe substantially seals the hole and at an open location where the inner pipe unseals the hole.

18. The apparatus according to claim 17 wherein the inner pipe is adapted for connection to means for retrieving the apparatus from the conduit so that when the apparatus is being retrieved, the inner pipe is pulled by the retrieving means to the open location at which position the inner pipe engages the outer pipe to facilitate withdrawal of the whole apparatus from the conduit, and wherein fluid above the apparatus can flow through the bypass valve and out the downstream end of the conduit.

19. An apparatus for delivering a flowable substance to a remote location through a conduit having an upstream end for insertion of the apparatus, a downstream end provided with an opening, and a stopping means for stopping the apparatus from falling out the downstream end of the conduit, said apparatus comprising at least:

a tubular member for holding a supply of said flowable substance;

a piston slidable through the tubular member and forming a first seal with said tubular member, the piston initially located upstream of the tubular member;

a first valve coupled to a downstream end of the tubular member the first valve having a body provided with at least one orifice and a sealing member slidably mounted on the body and biased to a sealing position in which it seals said at least one orifice; and, a fluid flow controller coupled upstream of the tubular member, said fluid flow controller including a peripheral seal for forming a second seal between the outer peripheral surface of the apparatus and an inner peripheral surface of the conduit upstream of the tubular member;

said apparatus being insertable in the upstream end of and transported through the conduit where, upon the sealing member abutting the stopping means, fluid pressure is applied to the apparatus through the conduit displacing the sealing member away from the sealing position to unseal any one or more of the at least one orifice and pushing said piston through the tubular member to force the flowable substance through any one or more of the at least one orifice and out the downstream end of the conduit.

20. An apparatus according to claim 19 wherein the fluid flow controller includes a bypass valve at the upstream end of the apparatus and movable between a closed position in which the fluid is substantially confined to act directly on the piston, and an open position providing fluid communication between the upstream end of the apparatus, a space formed between the outer peripheral surface of the apparatus and the inner peripheral surface of the conduit downstream of the peripheral seal and the opening at the downstream end of the conduit, said bypass valve being operable to switch to the open position when the apparatus is being withdrawn from the conduit.

21. The apparatus according to claim 21 wherein said fluid flow controller further includes an outer pipe which is provided with said peripheral seal, and the bypass valve includes a hole in the outer pipe and an inner pipe slidable within the outer pipe between a closed location where the inner pipe substantially seals the hole and at an open location where the inner pipe unseals the hole.

22. The apparatus according to claim 21 wherein the inner pipe is adapted for connection to means for retrieving the apparatus from the conduit so that when the apparatus is being retrieved, the inner pipe is pulled by the retrieving means to the open location at which position the inner pipe engages the outer pipe to facilitate withdrawal of the whole apparatus from the conduit, and wherein fluid above the apparatus can flow through the bypass valve and out the downstream end of the conduit.

23. An apparatus according to claim 19 wherein said first seal formed by the piston in the tubular member is arranged to fail when the fluid pressure exerted exceeds a predetermined level so that the fluid exerting the pressure can bypass or otherwise flow through the piston and subsequently flow through any one or more of orifices unsealed by the sealing member and out the downstream end of the conduit.

24. An apparatus according to claim 23 wherein said piston includes a passageway extending axially there through and a plug demountably held in the passageway for initially closing said passageway, said plug being ejected from said passageway to open said passageway when the fluid pressure exceeds said predetermined level to facilitate said failure of said first seal.

25. An apparatus according to claim 24 wherein said passageway is provided with a recess for snap fitting of said plug for initially closing the passageway.

26. An apparatus according to claim 25 wherein said piston is provided with an inner cylindrical body defining the passageway, and wherein said plug for initially closing the passageway is a ball.

27. An apparatus according to claim 26 further including a bypass insert held with said first valve downstream of said piston for spacing said ball from said at least one orifice and maintaining a fluid flow path around said ball to said at least one orifice.

28. The apparatus according to claim 19 further comprising a resilient sealing ring for biasing the sealing member toward the sealing position, the resilient sealing ring disposed about the body of the first valve and adapted to form a first seal between the an outer peripheral surface of the apparatus and an inner surface of the conduit near the downstream end of the conduit when the sealing member is displaced away from the sealing position.

29. An apparatus according to claim 28 wherein the body includes a constant diameter portion on which the sealing member is mounted and a contiguous tapered portion having increasing outer diameter in an upstream direction so that when the sealing member is displaced away from the sealing position, the sealing member forces the resilient sealing ring up the tapered portion, radially outwardly expanding the resilient sealing ring into substantial sealing contact between the inner peripheral surface of the conduit and the outer peripheral surface of the apparatus.

* * * * *